United States Patent [19]

Cottrell

[11] 4,048,761

[45] Sept. 20, 1977

[54] PAPER STICK POINTING APPARATUS

[75] Inventor: Edward D. Cottrell, Cattaraugus, N.Y.

[73] Assignee: Champion International Corporation, Stamford, Conn.

[21] Appl. No.: 703,971

[22] Filed: July 9, 1976

[51] Int. Cl.[2] ..... B24B 3/60; B24B 21/02

[52] U.S. Cl. ..... 51/138; 51/142; 51/215 M

[58] Field of Search ..... 51/137–139, 51/142, 76 R, 38, 39, 215 M, 215 E; 144/30, 245 A

[56] References Cited

U.S. PATENT DOCUMENTS

| | | | |
|---|---|---|---|
| 188,569 | 3/1877 | Beers | 51/215 M |
| 339,361 | 4/1886 | Beers | 51/142 X |
| 593,067 | 11/1897 | Gowen | 51/137 X |
| 647,485 | 4/1900 | Eberling | 51/76 R |
| 1,175,831 | 3/1916 | Spinney | 144/30 |
| 2,109,450 | 3/1938 | Schlayer | 51/215 M |
| 2,714,278 | 8/1955 | Dostert | 51/137 X |
| 3,888,048 | 6/1975 | Cauffiel | 51/39 |
| 3,909,986 | 10/1975 | Miyazawa | 51/138 |

FOREIGN PATENT DOCUMENTS

| | | | |
|---|---|---|---|
| 1,400,105 | 7/1975 | United Kingdom | 51/39 |

*Primary Examiner*—Harold D. Whitehead
*Assistant Examiner*—Nicholas P. Godici
*Attorney, Agent, or Firm*—Evelyn M. Sommer

[57] ABSTRACT

Apparatus for grinding conical points on the ends of paper sticks. The sticks are fed one at a time in spaced relation to pockets on an endless carrier. The sticks have one end extending beyond a lateral edge of the carrier which are ground to a conical point by an abrasive belt supported at an acute angle to the axis of the carrier. The sticks are rotated counter to the direction of travel of the abrasive belt in the carrier pockets by upper and lower contact belts as they are ground to expedite the grinding operation. The abrasive belt is reciprocable 90° to its direction of travel to effect an even distribution of the cutting action over the belt surface.

2 Claims, 7 Drawing Figures

Fig. 1.
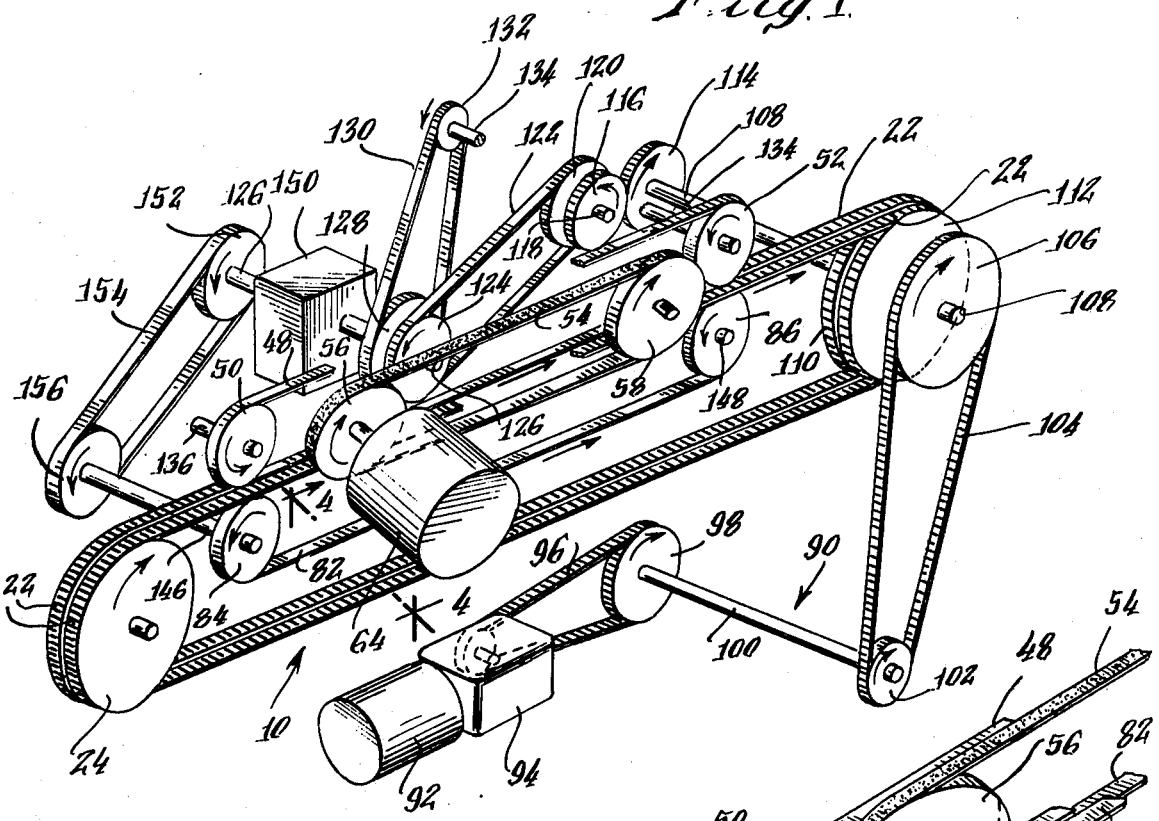
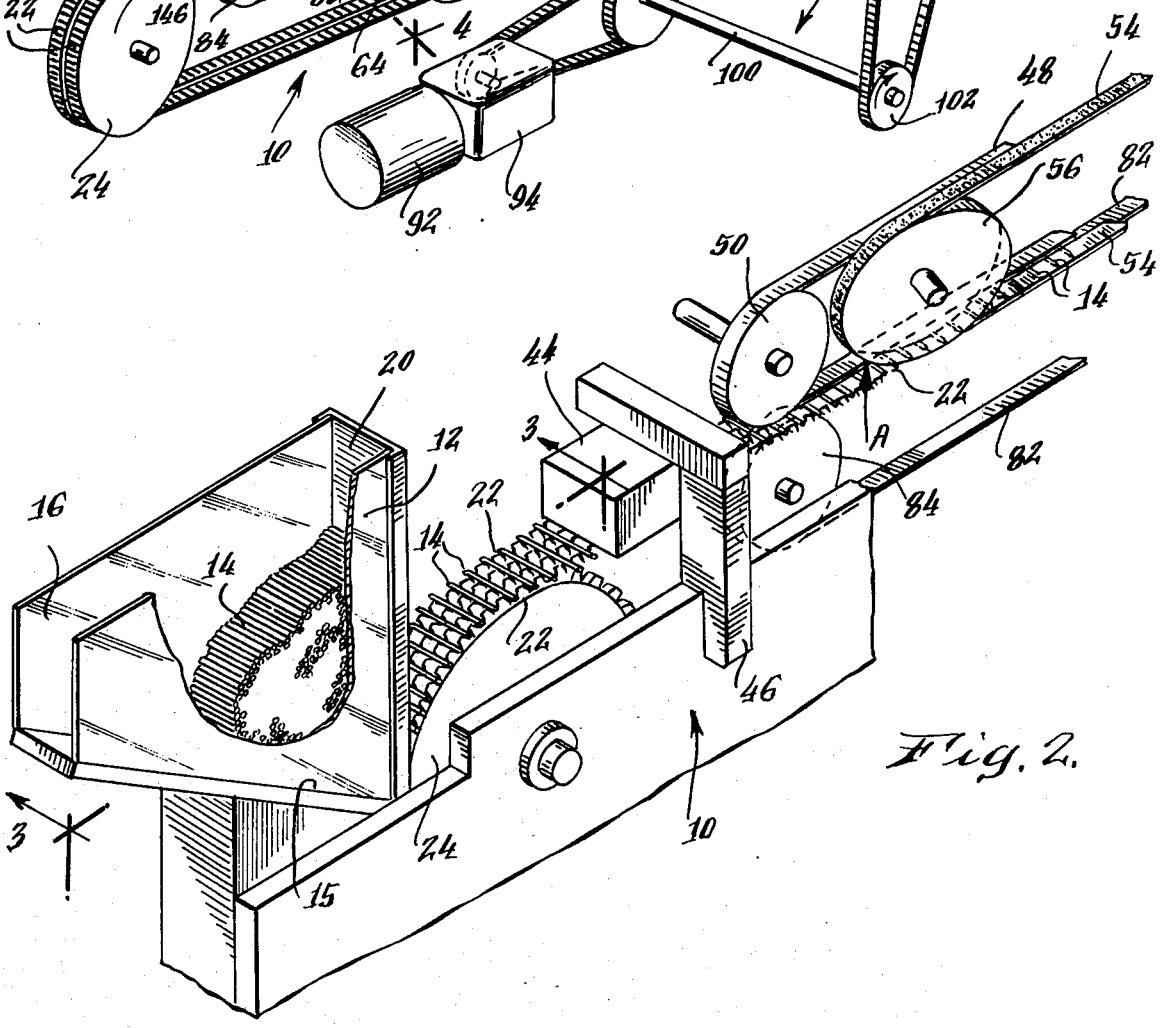
Fig. 2.

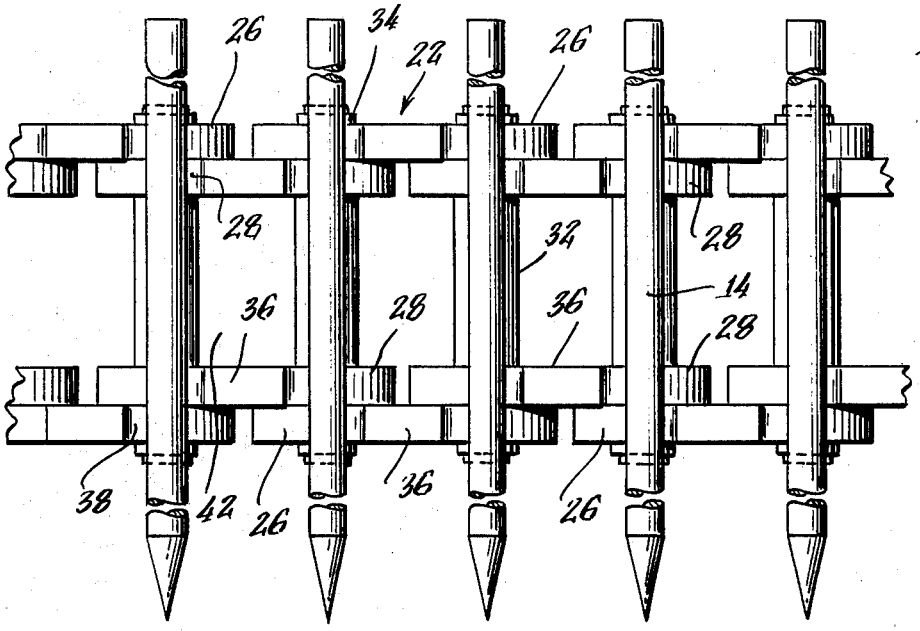
Fig. 5.
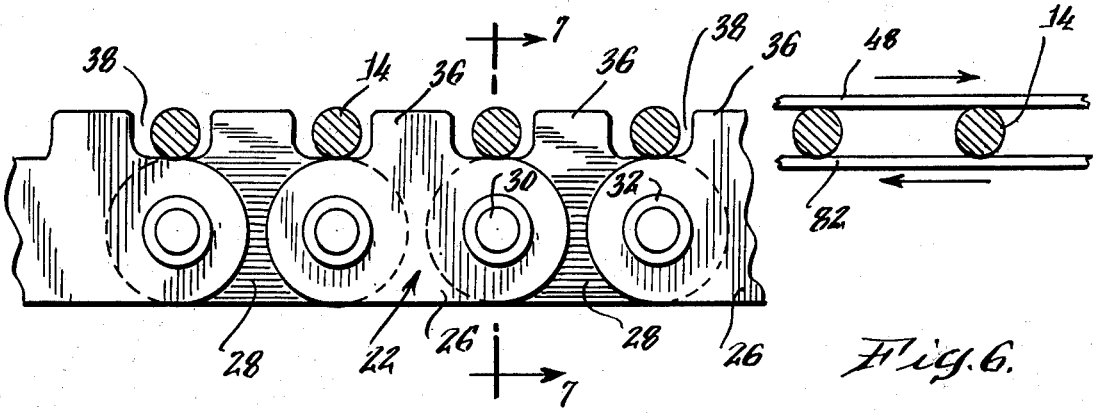
Fig. 6.
Fig. 7.
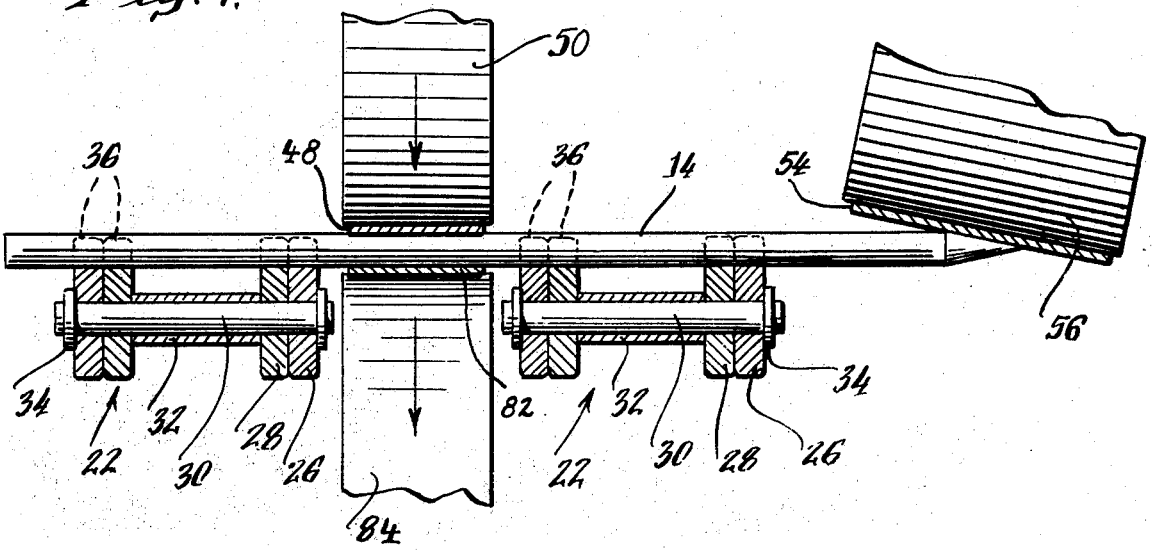

PAPER STICK POINTING APPARATUS

BACKGROUND OF THE INVENTION

1. Field of the Invention

This invention relates to an apparatus for grinding the ends of cylindrical paper sticks to a conical point.

2. Description of the Prior Art

Pointed cylindrical paper sticks are used as a holder inserted into a variety of diverse products, such as confections, feminine hygiene tampons and the like. The pointing of a paper stick at high rates of production cannot be achieved through the use of conventional wood-working techniques, such as with high speed revolving cutters, owing to the highly abrasive nature of paper and its poor machining characteristics. One practical approach to this machining problem has been found in the area of abrasive belt machining of the ends of the paper sticks which yields consistent results and low operating expense in terms of belt replacement.

SUMMARY OF THE INVENTION

In accordance with the invention, the apparatus to point the paper sticks includes an infeed hopper into which the unpointed cylindrical sticks are loaded in bulk. The sticks are removed raipidly from the hopper by a pair of endless carrier chains which space the sticks with their ends extending beyond the lateral edges of one of the chains and conveys them to a pointing station. An endless belt is positioned above and below the chains in contact with the sticks to carry the sticks synchronously with the carrier chains to the pointing station while imparting rotation to each stick counter to the direction of travel of an abrasive belt at the pointing station. The abrasive belt positioned at the pointing station generates a gradual abrasive cutting action on the end of each stick as it passes through the pointing station on the endless carrier chains. The belt is also reciprocated 90° to the direction of travel of the belt to effect a distribution of the cutting action of the belt over its usable surface. The pointed sticks are then collected on a runout conveyor from which an operator loads the finished sticks into shipping cartons.

BRIEF DESCRIPTION OF THE DRAWING

Further objects and advantages of the invention will become apparent from the following description and claims, and from the accompanying drawings, wherein:

FIG. 1 is a diagrammatic perspective view of the paper stick pointing apparatus of the present invention;

FIG. 2 is an enlarged partial perspective view of the upstream portion of the apparatus of FIG. 1;

FIG. 5 is a top plan view of a portion of the stick conveying chains of the apparatus of FIG. 1;

FIG. 6 is a side view in elevation of the portion of the stick conveying chain of FIG. 5; and FIG. 7 is a cross-sectional view taken substantially along the plane indicated by line 7—7 of FIG. 6.

DETAILED DESCRIPTION OF THE PREFERRED EMBODIMENT

Figure 3:
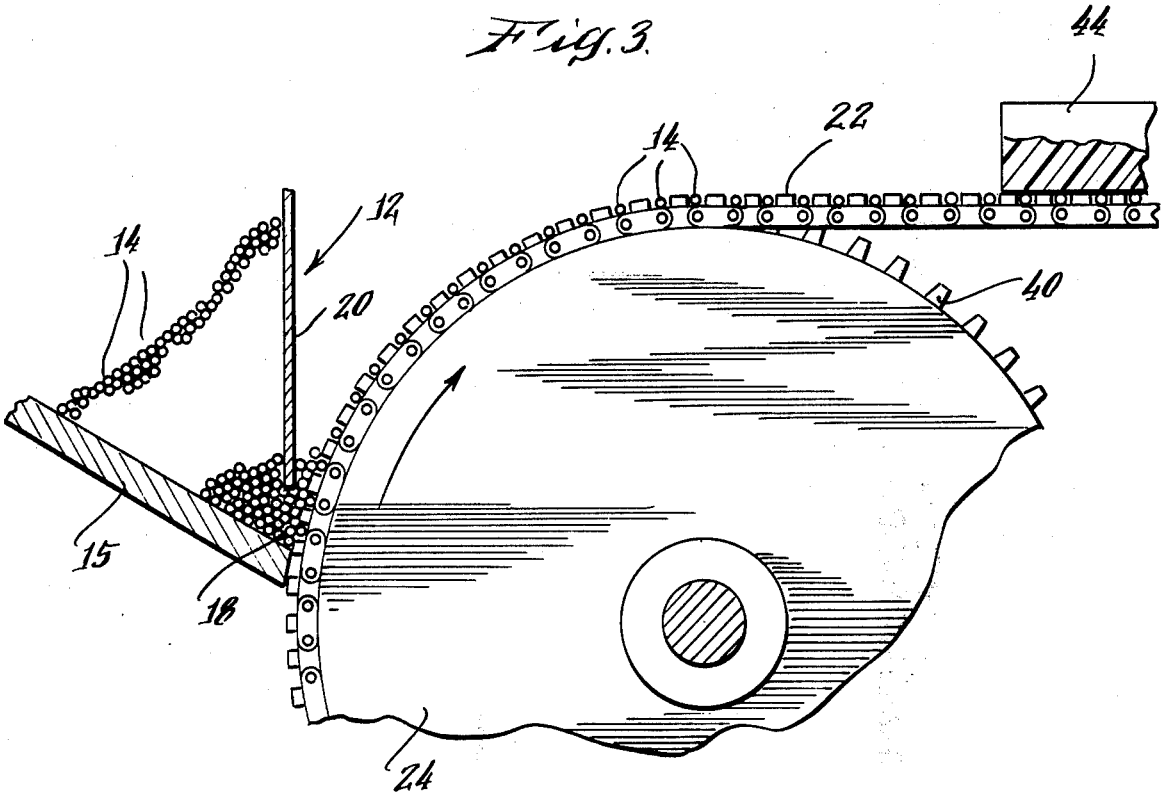
FIG. 3 is a partial, cross-sectional view taken substantially along the plane indicated by line 3—3 of FIG. 2.

Referring now to the drawings in detail, wherein like numerals indicate like elements throughout the several views, the apparatus 10 of the present invention includes an inclined, substantially enclosed feed hopper 12 into which a plurality of unpointed, cylindrical paper sticks 14 are loaded in bulk by an operator. The sticks 14 are loaded through an open rear surface 16 in hopper 12.

The sticks 14 are fed by gravity one at a time down an inclined ramp 15 through an opening 18 in the bottom of the front wall 20 of hopper 12 onto a pair of side-by-side endless carrier chains 22 driven in synchronization by a pair of sprocket wheels 24 mounted side-by-side on the frame of apparatus 10.

As shown in FIGS. 5 to 7, inclusive, chains 22 are each formed from a plurality of overlapped inner and outer links 28, 26, respectively, forming opposite parallel edges of each individual chain 22. Overlapping portions of each pair of inner and outer links 28, 26 are pivotably connected to each other and paired links on the opposite parallel edge by a cylindrical pin 30 housed within a spacer sleeve 32 mounted between the inner links 28. Clips 34 retain pins 30 on links 26, 28. The center portion of each of the links 26, 28 includes a rectangular upright 36.

Adjacent uprights 36 on the overlapped links 26, 28 of each chain 22 form a pocket 38 for receiving sticks 14 fed from hopper 12 in spaced relation with their opposite ends extending beyond the edges of each chain 22 as the chains 22 pass opening 18 in the hopper. Sprocket teeth 40 on each sprocket wheel 24 fit between the pairs of overlapped links 26, 28 on opposite edges of one of the chains 22 in the space 42 between adjacent sleeves 32, and moves the chain 22 so that sticks 14 falling from the opening 18 are abutted by successive uprights 36 which push each stick into one of the pockets 38.

The chains 22 carrying the sticks 14 pass under a plastic block 44 suspended from the frame 46 of apparatus 10. Block 44 is spaced above chains 22 an amount just sufficient to enable one stick 14 in each of the pockets 38 to pass thereunder. If two sticks 14 are inadvertently stacked in one pair of side-by-side pockets 38, block 44 will only permit one to pass to the pointing station.

An endless belt 48 mounted between rollers 50 and 52 is positioned above the chains 22 in contact with sticks 14 downstream from block 44. Similarly, an endless belt 82 mounted between rollers 84 and 86 is positioned below chains 22 in contact with the stick 14. Belts 48 and 82 have a lower and upper run, respectively, whose speed and direction of travel is synchronized with movement of the carrier chains 22, the net effect of which is to push sticks 14 towards the pointing station while imparting rotation to each stick 14 in adjacent pockets 38 counter to the direction of travel of an abrasive belt 54 defining the commencement of a pointing station A.

Figure 4:
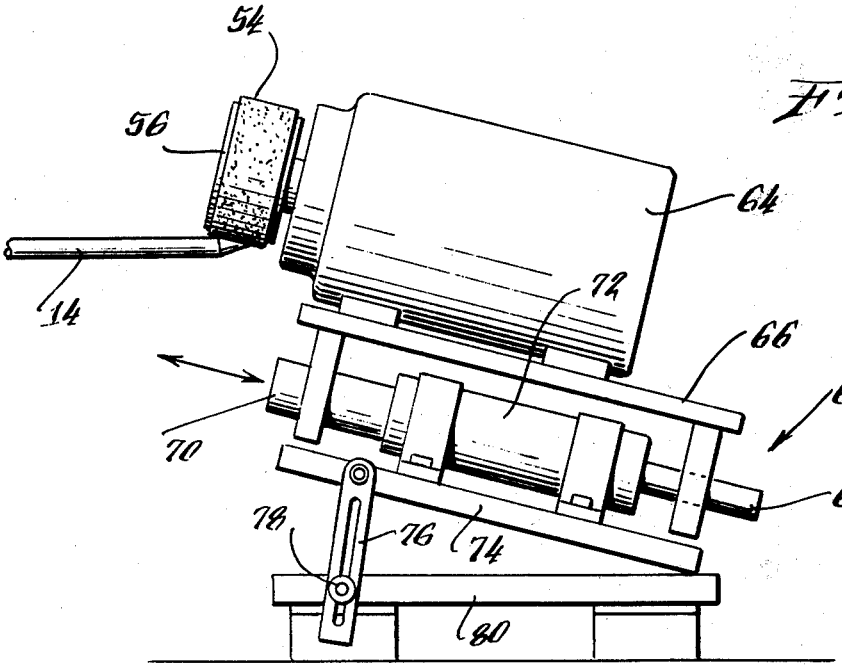
FIG. 4 is an end view in elevation of a portion of the apparatus of FIG. 1, as seen along the plane indicated by line 4—4 of FIG. 1.

The abrasive belt 54 is supported between a driven roller 56 and an idler roller 58. The driven roller 56 is disposed at an acute angle to one lateral edge of carrier chains 22 and contacts the ends of cylindrical sticks 14 extending beyond the edge of one of the chains 22 to generate a gradual abrasive cutting action along its contact length on the end of each stick 14 as it passes through the pointing station A on the endless chains 22. Because of the angular relation between the belt 54 and each stick 14, a conical point is cut on the end of each stick, as shown in FIGS. 4 and 7.

The angle of the point cut by belt 54 may be varied by adjusting the angular relation of belt 54 with the end of each stick 14. This is accomplished by providing an adjustable base 62 mounting motor 64 drivingly connected to drive roller 56.

Motor 64 is supported on an upper platform 66 carried on the reciprocating pistons 68, 70 of a dual piston air cylinder 72 clamped to a lower platform 74. Platform 74 is pivotably mounted on the end of a slotted bracket 76 connected by a bolt 78 to a stationary base platform 80. By raising or lowering bracket 76, the angle of the belt 54 relative to stick 14 can be adjusted.

By virtue of the reciprocation of upper platform 66 by air cylinder 72, belt 54 is reciprocated 90° to the direction of travel of the belt to effect a distribution of the cutting action of the belt over the usable surface of the belt, substantially extending its life. While reciprocation by cylinder 72 has been illustrated, any mechanically equivalent system, such as an eccentric cam-actuated linkage connected to upper platform 66 is within the purview of the invention.

As shown in FIG. 1, the drive of chains 22 and upper and lower belts 54, 82 are synchronized with each other and the motor drive of abrasive belt 54 by a drive train 90 including a motor 92 driving a transmission 94. The output of transmission 94 drives a chain 96 which rotates sprocket 98 on the end of shaft 100. Shaft 100 has a sprocket 102 mounted on its opposite end which drives a chain 104 to rotate a sprocket 106 fixed to shaft 108. Mounted intermediate the ends of shaft 108 are a pair of side-by-side sprockets 110, 112 which drive chains 22. Sprockets 110, 112 have teeth which are positioned intermediate the pairs of overlapped links 26, 28 on side-by-side chains 22. Sprockets 110, 112 cause sprockets 24 to rotate via chains 22 to also drive chains 22.

Shaft 108 also has a gear 114 fixed to the end thereof in meshing engagement with a gear 116. Gear 116 is mounted on a shaft 118 which also has a sprocket 120 fixed thereto. Sprocket 120 drives chain 122 which is also connected to a sprocket 124 on a shaft 126. A second sprocket 128 is mounted on one end of the shaft 126 which drives a chain 130. Chain 130 turns a sprocket 132 fixed to and rotating a shaft 134. Shaft 134 drives rollers 52 and 50 mounting upper belt 54. Roller 50 is mounted on a shaft 136.

Shaft 126 also drives an infinitely variable transmission 150, whose output shaft rotates a roller 152. Roller 152 drives a belt 154 which drives a roller 156 mounted on a shaft 146. Rotation of shaft 146 rotates roller 84 which causes lower belt 82 to travel about roller 86 mounted on a shaft 148 in a direction opposite to the direction of travel of upper belt 54.

What is claimed is:

1. An apparatus for forming a substantially conical point on a cylindrical workpiece comprising, a combination:

a. endless carrier means for transporting individual ones of said cylindrical work pieces to a pointing station with one end of said work piece projecting beyond a lateral edge of said carrier means, said endless carrier including a pair of chains each chain of said chain pair having a plurality of identical inner and outer links disposed in an overlapping portion relationship forming opposite parallel edges of each said chain, said overlapping chain portions being pivotally connected to each other, each said link being provided with a centrally disposed upright portion, adjacent link upright portions forming a pocket for receiving one of said work pieces therein;

b. hopper means cooperating with said carrier means for supplying individual work pieces to each said carrier means pockets;

c. a pair of endless belts, one of said belt pair being disposed below said work pieces, said pair of endless belts being disposed between said chains of said chain pair, said upper belt having a lower run in contact with said work pieces and said lower belt having an upper run in contact with said work pieces, said upper and lower runs moving in opposite directions for rotating said work pieces; and d. abrasive means at said pointing station for contact with the end of said rotating work piece for grinding said end into a conical point.

2. An apparatus according to claim 1 wherein said abrasive means includes an endless belt having an abrasive surface in contact with one end of said work pieces at an acute angle to the longitudinal axis thereof, said endless belt being reciprocated perpendicular to the longitudinal axis of said abrasive belt.

* * * * *

UNITED STATES PATENT OFFICE

CERTIFICATE OF CORRECTION

Patent No. 4,048,761 Dated September 20, 1977

Inventor(s) Edward D. Cottrell

It is certified that error appears in the above-identified patent and that said Letters Patent are hereby corrected as shown below:

In Column 4, line 10 thereof, delete the word "a" (second occurrence) and insert in lieu thereof -- in -- .

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*